US005527193A

United States Patent [19]

Doelcher

[11] Patent Number: 5,527,193

[45] Date of Patent: Jun. 18, 1996

[54] COVERS FOR BOAT BLADES OF PROPELLERS OF IN-BOARD AND OUTBOARD BOAT MOTORS

[76] Inventor: Jack R. Doelcher, 1234 Military West, Benicia, Calif. 94510

[21] Appl. No.: 374,199

[22] Filed: Jan. 18, 1995

[51] Int. Cl.[6] ..... B63H 1/14

[52] U.S. Cl. ..... 440/49; 416/62; 416/146 R

[58] Field of Search ..... 416/62, 224, 146 R; 440/49, 113, 900

[56] References Cited

U.S. PATENT DOCUMENTS

| | | | |
|---|---|---|---|
| 2,949,092 | 8/1960 | Fortune | 416/62 |
| 2,990,889 | 7/1961 | Welch | 416/62 |
| 4,161,056 | 7/1979 | Dunham | 416/224 |
| 4,832,572 | 5/1989 | Prucha et al. | 416/62 |
| 5,273,399 | 12/1993 | Ojeda | 416/62 |

*Primary Examiner*—Stephen Avila
*Attorney, Agent, or Firm*—Harold D. Messner

[57] ABSTRACT

The invention relates to hand-insertable, rigid plastic cover for use with an individual boat blade of a propeller of an in-board or outboard boat motor wherein each cover of the invention is integrally formed as a single unit using of a conventional plastic material such as polyethylene. Briefly, the plastic cover of the invention comprises a pair of broad side walls of a tear-dropped or elliptically shape placed in a side-by-side relationship and terminating at a U-shaped closed edge or end wall but being open at a concavely formed, transverse open top to permit easily insertion over the leading and trailing edges of each blade. The shape of the broad side walls, the use of a U-shaped closed edge, the capability of the side walls to outwardly flex for insertion over the cross section of the blade, and the use of a rigid plastic such as polyethylene, permits the cover to be pushed over the blade from a position exterior of the leading and trailing edges of the blade using a section of the closed edge as the push region for the user's hand. Due to the sufficient stiffness provided by the invention, the cover can then be easily and safely advanced by the user to move the cover over the broad surfaces of the blade so that at least 80% of the leading and trailing edges of the blade are covered.

4 Claims, 4 Drawing Sheets

COVERS FOR BOAT BLADES OF PROPELLERS OF IN-BOARD AND OUTBOARD BOAT MOTORS

SCOPE OF THE INVENTION

The present invention relates to an integrally formed plastic cover for use in association with an individual boat blade of a propeller of an in-board or outboard boat motor wherein each cover of the invention is integrally formed as a single unit using of a conventional plastic material such as polyethylene, such single unit being the product of a conventional injection molding process.

in one aspect, the finished cover also includes side-by-side first and second broad side walls terminating along closed U-shaped edge to a form a cavity or pocket interior thereof but being open along top edges to permit insertion of the invention over the leading edge of each blade. The walls and U-shaped closed edge also are provided with sufficient stiffness and rigidity so that the cover can then be advanced by the user to move the open edges of the cover over the broad surfaces of the blade until at least 80% of the leading and trailing edges of the blade are covered. In another aspect, the U-shaped edge of the finished cover is defined by a series of interconnected centers of formation of differing radii wherein such centers are positioned at locations both interior and exterior of the edge.

BACKGROUND OF THE INVENTION

Off-shore storage of boats involving trailering them between use and storage sites, is a common practice. Reason: more reasonable berthing costs or charges, occur away from a boat harbor. At such sites, the boat usually remains on its trailer. However, if such site is at the boater's home, there is a possibility of traffic about the stern of the boat in the vicinity of the blades of the boat motor. Since the edges of each blade can have a sharpness to them, there is a possibility of injury to any passerby. Also, due to the exposure of the blades to the elements, the edges have a tendency to dull and pit. Note that the use of a sock as a cover such as used for golf clubs is impractical since the fabric used in the construction of the sock can be damaged by the blade edges during insertion and removal; and the insertion and removal steps of the sock can be dangerous since the sock can only be pulled over the blade (whose hub is affixed to a central shaft) which places the user's hands in the vicinity of the blade edges.

SUMMARY OF THE INVENTION

The invention relates to hand-insertable, rigid plastic cover for use with an individual boat blade of a propeller of an in-board or outboard boat motor wherein each cover of the invention is integrally formed as a single unit using of a conventional plastic material such as polyethylene, such single unit being the product of a conventional injection molding process. Briefly, the plastic cover of the invention comprises a pair of broad side walls of tear-dropped or elliptically shape placed in a side-by-side relationship and terminating at a continuous U-shaped side and bottom edge but being open at a concavely formed, transverse open top to permit easily insertion over the leading and trailing edges of each blade. The shape of the broad side walls, the use of a U-shaped closed edge, the capability of the side walls to outwardly flex for insertion over the cross section of the blade, and the use of a rigid plastic such as polyethylene, permits the cover to be pushed over the blade from a position exterior of the leading and trailing edges of the blade using a section of the closed edge as the push region for the user's hand. Due to the sufficient stiffness provided by the invention, the cover can then be easily and safely advanced by the user to move the cover over the broad surfaces of the blade so that at least 80% of the leading and trailing edges of the blade are covered. In another aspect, the U-shaped side and bottom edge of the finished cover are defined by a series of interconnected centers of formation of differing radii wherein such centers are positioned at locations both interior and exterior of the finished cover but wherein the major section of open top edges are concavely shaped, having radii positioned at a center of formation that is exclusively exterior of the cover.

DETAILED DESCRIPTION OF THE INVENTION

Figure 1:
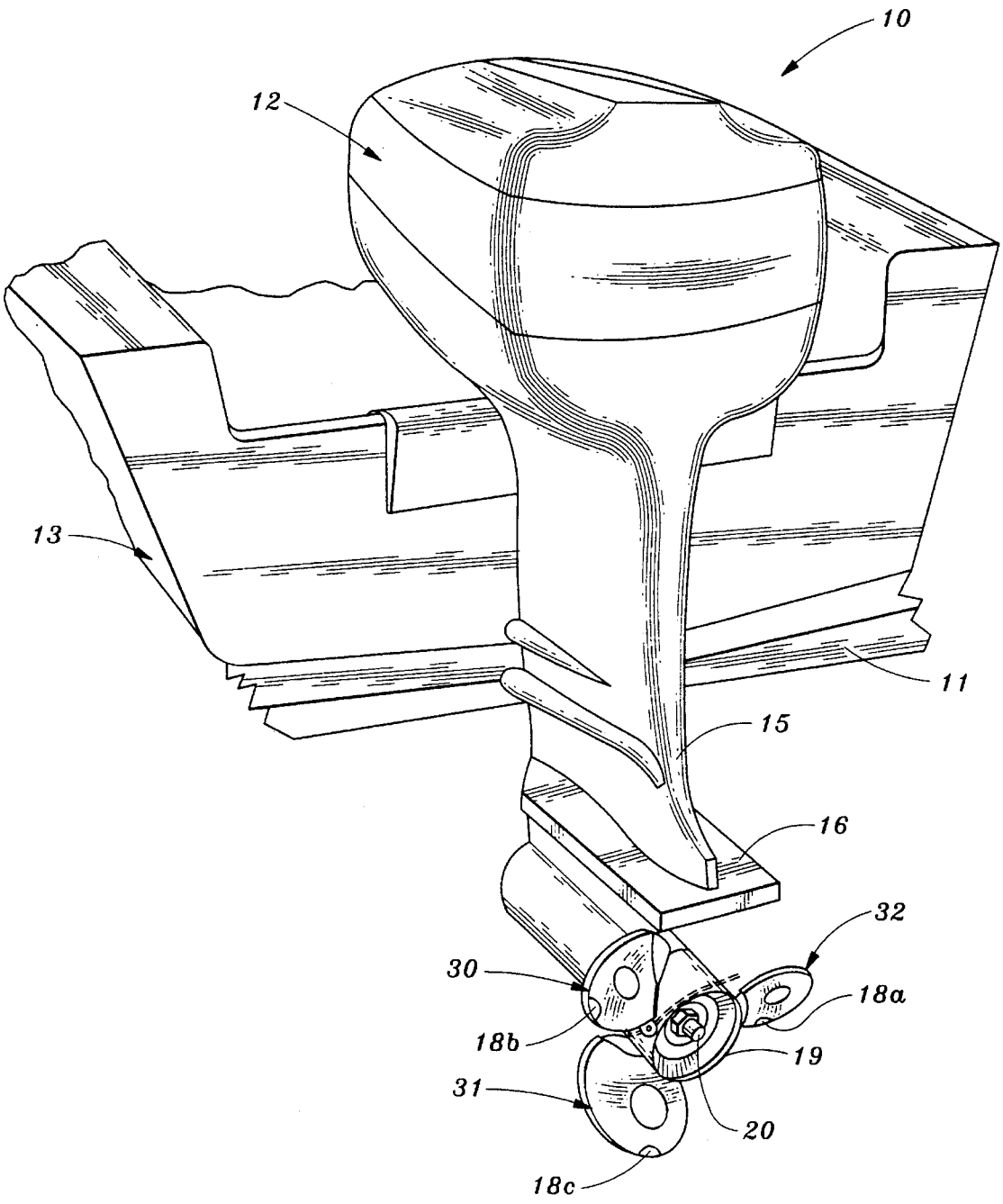
FIG. 1 is a perspective view of an outboard motor attached to a boat in which the blades of the motor are provided with the covers constructed in accordance with the invention.

As shown in FIG. 1, a motor boat 10 is supported by a trailer 11 and includes a outboard motor 12 attached to stern 13 of the boat 10. The outboard motor 12 includes a central post 15 and cavitation plate 16 attached to the post 15. Below the plate 15 and attached to the post 15 is propeller 17. The propeller 17 includes a series of blades **18*a*, 18*b* and 18*c* attached to hub 19 rotatably mounted to shaft 20 wherein the blades 18*a*, 18*b*, 18*c* are seer to be releasably enclosed within a series of covers 32, 30, 31**, respectively, of the invention.

Figure 2:
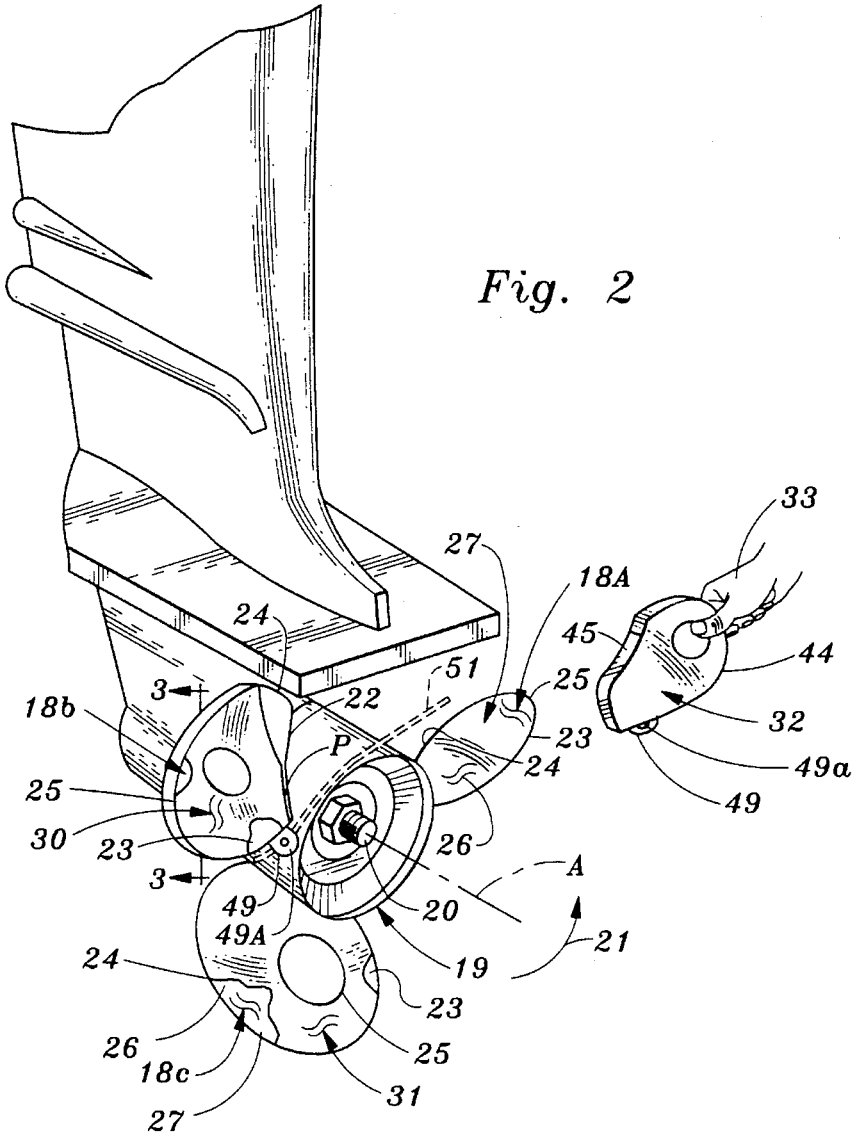
FIG. 2 is a partial perspective view of the blades of the motor of FIG. 1 enlarged to better illustrate insertions of one of the covers constructed in accordance with the invention.

FIG. 2 shows blades **18*a*, 18*b* and 18*c*** in more detail.

As shown, each blade **18*a*, 18*b*, 18*c* rotates about axis of rotation A of shaft 20 in the direction of arrow 21 and includes a haft section 22 attached to the hub 19, a leading edge 23, a trailing edge 24, and a demarcation point 25 between the edges 23, 24 most radially remote relative to axis of rotation A. The pitch P of each blade 18*a*, 18*b*, 18*c* is defined by the slope of the haft section 22 with the hub 19. In addition to the leading edge 23, trailing edge 24, demarcation point 25 between the edges 23, 24, each blade 18*a*, 18*b*, 18*c* also includes first and second broad surfaces 26, 27. The broad surfaces 26, 27 are slightly curved or inwardly cupped at the intersection of the haft section 22 with the hub 19**.

Individually attachable to the blades 18*b*, 18*c* in FIG. 2, are the pair of covers indicated at 30, 31, respective, each having been inserted over the broad surfaces 26, 27 wherein at least 80% of the leading and trailing edges 26, 27 are covered. While cover 32 is shown being held by a hand 33 of the user (not shown) during insertion of the cover 32 relative to the blade 18*a*. Note that cover 32 is seen to be positionable by first placing the cover 32 in a position that is symmetrical to demarcation point 25 of the edges 23, 24 of the blade 18*a*. Subsequently, inwardly directed push force (relative to the axis of rotation A) correctly positions each of the covers 32, 30, 31 relative to the blades 18*a*, 18*b*, 18*c* , respectively.

Figure 3:
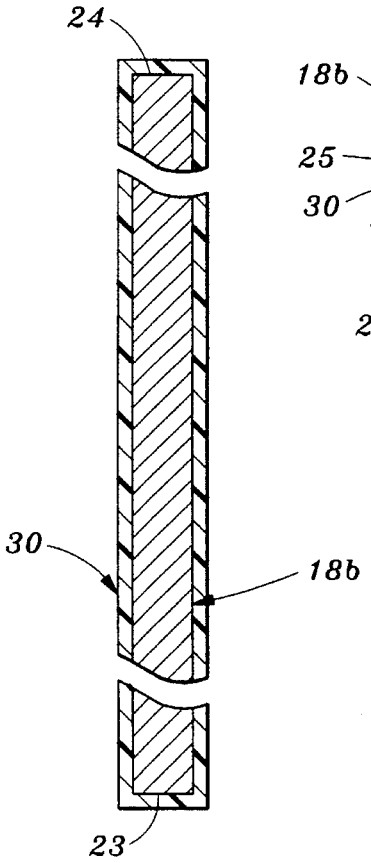
FIG. 3 is a section taken along line 3—3 of FIG. 2.

FIG. 3 shows the position of the cover 30 in fixed position over and about blade 18*b*. As shown, the cover 30 protects edges 23, 24 from outside forces that would inflict damage as well as protects the edges 23, 24 from weathering elements.

FIGS. 4–10 shows covers 30, 31, and 32 in more detail. Since each is identical to the other, a description of one fits all.

Figure 4:
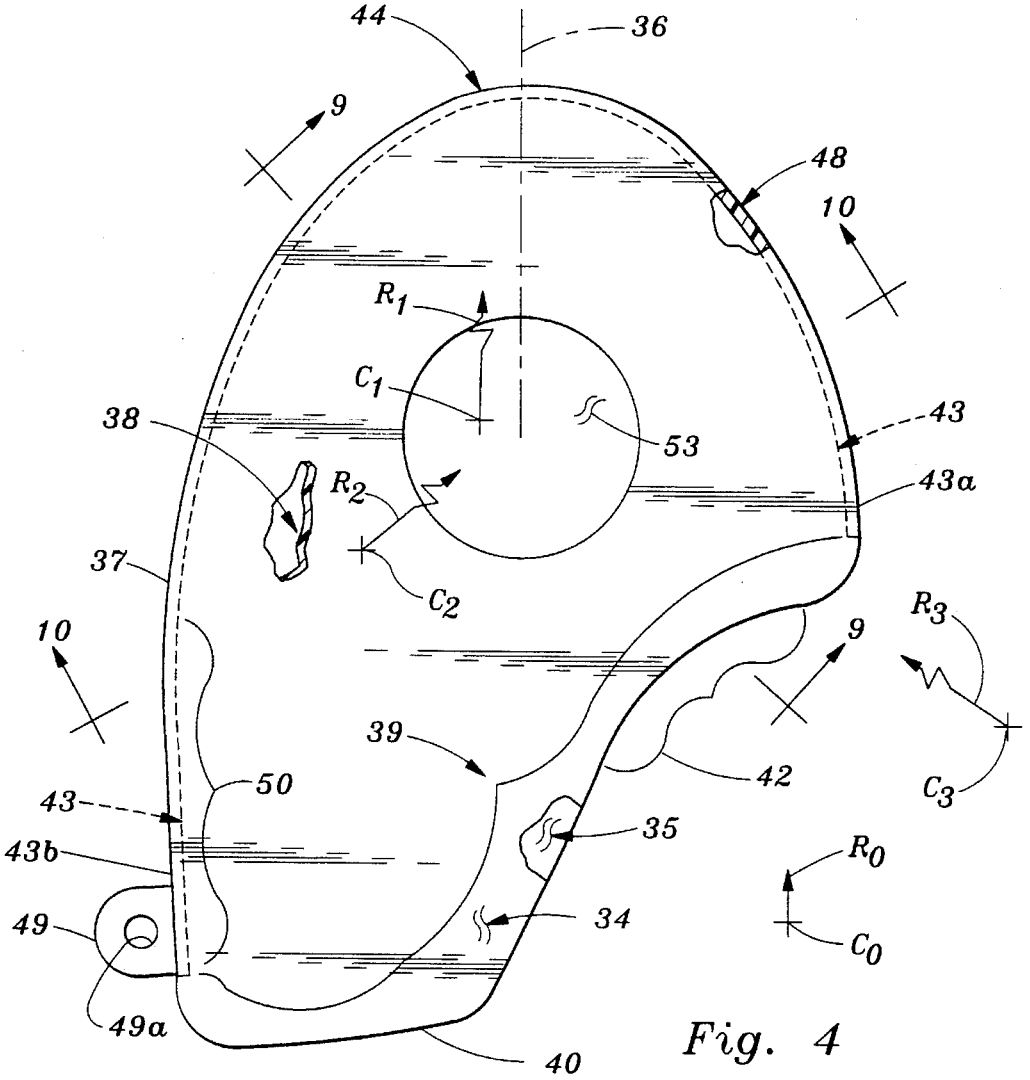
FIG. 4 is a top elevational view of the cover of FIG. 2 completely removed from contact with the blade of the motor boat.

As shown in FIG. 4, the cover 30, 31, 32 comprises a pair of broad side walls 34, 35. Each side wall 34, 35 are of a general tear-dropped or elliptical shaped in plan view and are positioned face-to-face about a longitudinal axis of symmetry 36. The side walls 34, 35 terminate and are closed along a closed U-shaped edge or end wall 37 whereby a truncated ellipsoidal pocket 38 (see also FIGS. 6–10) is formed. Note also that the pocket 38 is formed with an entryway generally indicated 39 open along edge 40. Note edge 40 also includes a section 42 defined by a center of formation of radius Ro located at center Co wherein such center Co is positioned at a location that is exterior interior of the edges 37, 40.

Figure 6:
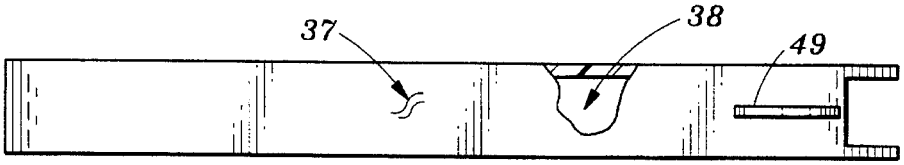
FIG. 6 is a left side elevational view of the cover of the invention.
Figure 7:
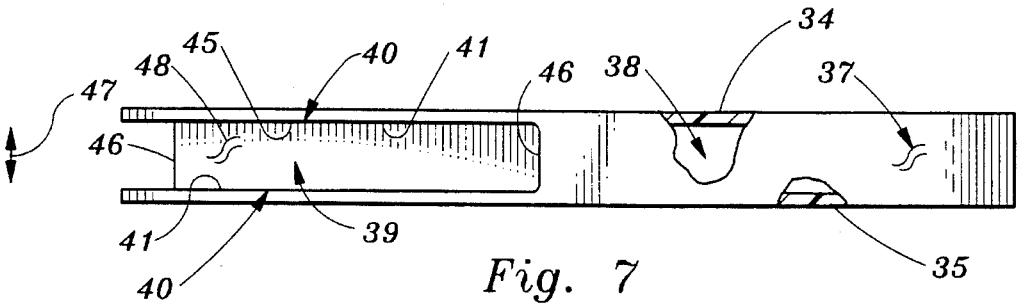
FIG. 7 is a right side elevational view of the cover of the invention.
Figure 8:
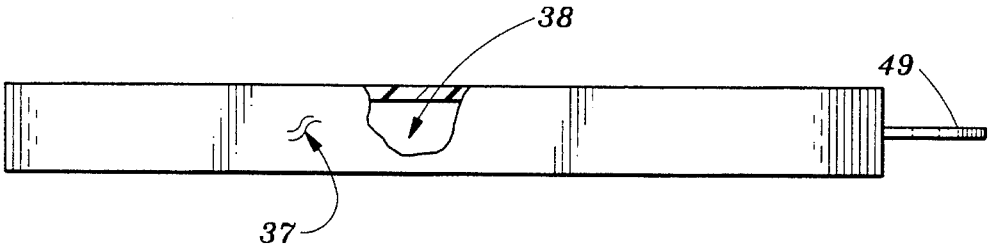
FIG. 8 is a rear elevational view of the cover of the invention.

As shown in FIGS. 6–8, the U-shaped closed edge 37 is continuous in a common longitudinal cutting plane therethrough. As shown in FIG. 4, edge 37 is seen to include a pair of side sections 43 interconnected by a transverse section 44. The side sections 43 are subdivided into a shorter arm 43*a* and a longer arm 43*b*, both of which having a laterally extending height of about ½ inch. The transverse section 44 is arcuately shaped, as shown, has a lateral height of about ½ inch and a thickness of about 1/16 inch, where the thickness of each side wall 34, 35 is about 1/16 inch.

Figure 5:
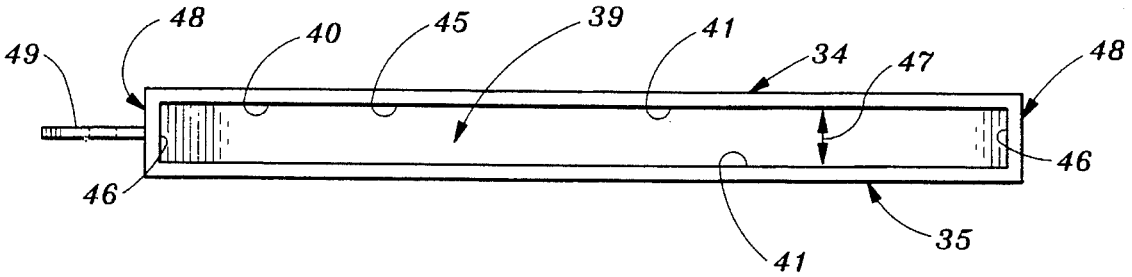
FIG. 5 is a front elevational view of the cover of FIG. 4.

As shown in FIGS. 5 and 7, the open top edge 40 defines an opening 45 of rectangular shape for entryway 39 that includes transverse, parallel sub-edges 41 integral of the pair of side walls 34, 35 and a pair of lateral sub-edges 46 associated with and integral with the U-shaped closed edge 37. Note that the defined rectangular opening 45 is elongatable in the lateral direction of arrow 47 to provide a maximum lateral dimension at axis of symmetry 36 of about 3 inches to permit easily excessable to the pocket 38 formed between the side walls 34, 35 and the U-shaped closed edge 37.

FIGS. 4, 5 and 7 show the closed U-shaped edge 37 in detail.

As shown in FIGS. 5 and 7, the edge 37 includes an upright planar wall 48 attached to and normal of the side walls 34, 35 of each cover 30–32. As shown in FIG. 4, one end of the planar wall 48 is fitted with a cantilevered ear segment 49 having a central opening 49*a*. Also, the edge 37 also is seen to be defined by a series of interconnected centers of formation of differing radii R1 . . . R3 located at centers C1 . . . C3 terminating in an linear end section 50. Note that such centers C1 . . . C3 are positioned at locations that are both interior and exterior of the edges 37, 40. In the preferred embodiment, differing radii have the following values: R1 is 2⅜ inches, R2 is 4 11/16 inches, and R3 is 7⅞ inches. The linear end section 50 is about 3⅜ inches.

OPERATIONAL ASPECTS

Returning to FIGS. 1 and 2 note that the covers 30–32 are easily insertable and removable relative to the blades 18*a*–18*c*. That is to say, as shown in detail in FIG. 2, the cover 32 is insertable over blade 18*a*. Result: at least 80% of the leading and trailing edges 26, 27 of the blade 18*a*can be covered. Such insertion requires the cover 32 be held by a hand 33 of the user (not shown). Note that cover 32 is seen to be symmetrical to demarcation point 25 of the edges 23, 24 of the blade 18*a*, insertion being via rectangular opening 45 over the leading and trailing edges 23, 24 of the blade 18*a*. With further reference to FIG. 2, note that after the cover 32 has been attached relative to blade 18*a*, an elastic string 51 can be inserted through opening 49*a* of cantilevered ear segment 49 of cover 32 and thence be connected to associated ear segments 49 of the covers 30, 31 to prevent detachment from the blades 18*a*, 18*b*, 18*c*, respectively, by providing a transverse force acting toward axis of rotation A.

Figure 9:
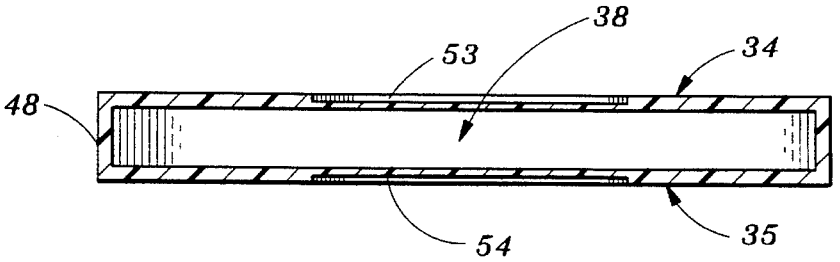
FIG. 9 is a section taken along line 9—9 of FIG. 4.
Figure 10:
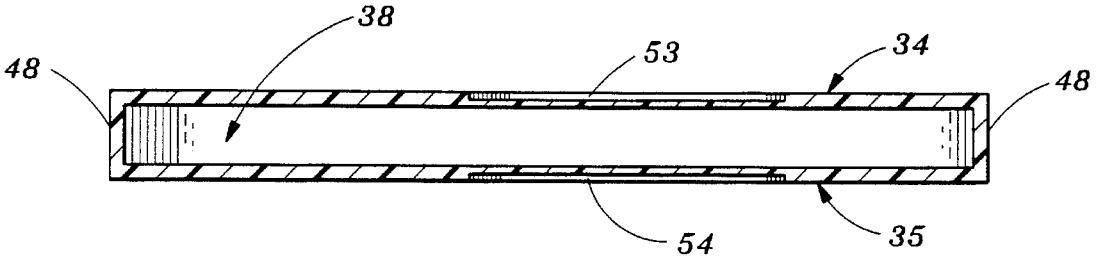
FIG. 10 is a section taken along line 10—10 of FIG. 4.

In addition, as shown in FIGS. 4, 9 and 10, as a final step, the covers 30–32 arc provided with light reflectors 53, 54 attached to broad side walls 34, 35, respectively. The light reflectors 53, 54 are conventionally formed of the same type of adhesive-backed reflective tape used by bicyclist and joggers as attachments to their clothing and the like.

Note that the following factors contribute to the easy usage of the cover 30–32:

(i) the tear-dropped or elliptical shape of the pair of broad side walls 34, 35 of each cover (FIG. 4) in their face-to-face position about axis of symmetry 36, matches the shape of the blades 18*a*, 18*b*, 18*c* (FIG. 2);

(ii) the closed U-shaped edge 37, permits the broad side walls 34, 35 to outwardly flex to accommodate different shaped blades 18*a*, 18*b*, 18*c* say those that relate to propellers of motors rated from 40 to 500 horsepower;

(iii) the cover 30–32 are formed of a rigid plastic such as polyethylene, so that the cover 30–32 can be positioned in covering position over the blade 18*a*, 18*b*, 18*c* using pushing action as depicted in FIG. 2. As shown in FIG. 2, cover 32 can be held by user's hand 33 as insertion of the cover 32 relative to the blade 18*a*, occurs. Note that cover 32 is seen to be symmetrical to demarcation point 25 of the edges 23, 24 as insertion begins. The user's hand 33 is placed against the transverse section 44 which is of sufficient thickness and height so the pushing force does not cause the side walls 34, 35 to collapse. In that way, the cover 32 can be easily and safely advanced by the user's hand 33 to move the cover 32 over the broad surfaces 26, 27 of the blade 18*a* to the position as depicted with regard to covers 30, 31 positioned relative to blades 18*b*, 18*c*. In that regard, the maximum lateral dimension of the opening 45 is about 3 inches.

The above description contains several specific embodiments of the invention but they are not intended to be construed as limitations on the scope of the invention, but merely as examples of preferred embodiments. Person skilled in the art can envision other obvious possible variations, modifications and changes therefrom and hence the scope of the invention is to be determined by the appended claims and their equal equivalents.

What is claimed is:

1. A plastic, integrally formed cover for enclosing a blade of a propeller of a motor for a boat, comprising (i) a pair of broad side walls facing each other in close proximity defining a longitudinal axis of symmetry therebetween, (ii) a terminating, closed U-shaped edge integrally attached to said pair of broad side walls thereby forming a pocket therewith, said pocket being shaped to receive a blade of a propeller of a motor for a motor boat and (iii) a transverse end edge integrally associated with said pair of broad side walls and said U-shaped closed edge for provide an entryway to permit easily insertion of said side walls over said blade into said pocket wherein said pair said walls and said U-shaped edge are sufficiently rigid to permit relative rectilinear movement by application of a pushing force applied to said cover relative to said blade without collapse of said pair of said walls, said terminating U-shaped edge being defined by a series of interconnected centers of formation of differing radii and terminating linear end section wherein such centers are positioned at locations that are both interior and exterior of the finished cover, said centers of formation defining differing radii R1, R2 and R3 associated with centers C1, C2 and C3 wherein R1 is 2⅜ inches, R2 is 4 11/16 inches, and R3 is 7⅞ inches and said terminating linear end section is about 3⅜ inches.

2. A plastic, integrally formed cover for enclosing a blade of a propeller of a motor for a boat, comprising (i) a pair of broad side walls facing each other in close approximity defining a longitudinal axis of symmetry therebetween, (ii) a terminating, closed U-shaped edge integrally attached to said pair of broad side walls thereby forming a pocket therewith, said pocket being shaped to receive a blade of a propeller of a motor for a motor boat and (iii) a transverse end edge integrally associated with said pair of broad side walls and said U-shaped closed edge for provide an entryway to permit easily insertion of said side walls over said blade into said pocket wherein said pair said walls and said U-shaped edge are sufficiently rigid to permit relative rectilinear movement by application of a pushing force applied to said cover relative to said blade without collapse of said pair of said walls, wherein said plastic cover is formed of rigid polyethylene and in which said terminating U-shaped edge is about ½ inch in height, 1/16 inch in thickness and in which each of said pair of side walls is about 1/16 inch.

3. In providing protection of the motor of a boat, the combination comprising, (i) a motor attached to said boat, said motor including a motor post ad a propeller rotatable mounted to said post, said propeller including a hub and a series of blades attached to said hub (ii) an integrally formed plastic cover attached to each of said series of blades for enclosure thereover, said cover comprising (a) a pair of broad side walls facing each other in close proximity defining a longitudinal axis of symmetry, (b) a terminating, closed U-shaped edge integrally connected to said pair of broad side walls thereby forming a pocket therewith, said pocket shaped to receive said blade of said propeller for enclosure therein, and (c) a transverse end edge integrally associated with said pair of broad side walls and said U-shaped closed edge for provide an entryway to permit easily insertion of said side walls over said blade into said pocket wherein said pair said walls and said U-shaped edge are sufficiently rigid to permit relative rectilinear movement therebetween by application of a pushing force applied to said cover relative to said blade without collapse of said pair of said walls, said terminating U-shaped edge of said cover being defined by a series of interconnected centers of formation of differing radii and a terminating linear end section wherein such centers are positioned at locations that are both interior and exterior of the finished cover, said centers of formation defining differing radii R1, R2 and R3 associated with centers C1, C2 and C3 wherein R1 is 2⅜ inches, R2 is 4 11/16 inches, and R3 is 7⅞ inches and said terminating linear end section is about 3 ⅜ inches.

4. In providing protection of the motor of a boat, the combination comprising, (i) a motor attached to said boat, said motor including a motor post and a propeller rotatable mounted to said post, said propeller including a hub and a series of blades attached to said hub, (ii) an integrally formed plastic cover attached to each of said series of blades for enclosure thereover, said cover comprising (a) a pair of broad side walls facing each other in close proximity defining a longitudinal axis of symmetry, (b) a terminating, closed U-shaped edge integrally connected to said pair of broad side walls thereby forming a pocket therewith, said pocket shaped to receive said blade of said propeller for enclosure therein, and (c) a transverse end edge integrally associated with said pair of broad side walls and said U-shaped closed edge for provide an entryway to permit easily insertion of said side walls over said blade into said pocket wherein said pair said walls and said U-shaped edge sufficiently rigid to permit relative rectilinear movement therebetween by application of a pushing force applied to said cover relative to said blade without collapse of said pair of said walls, wherein said plastic cover is formed of rigid polyethylene and in which said terminating U-shaped edge is about ½ inch in height, 1/16 inch in thickness and in which each of said pair of side walls is about 1/16 inch.

* * * * *